US005174771A

United States Patent [19]

Burgit et al.

[11] Patent Number: 5,174,771

[45] Date of Patent: Dec. 29, 1992

[54] ELECTRICAL CONNECTOR HAVING EXTERNALLY MOUNTED GROUND PLATES

[75] Inventors: Richard A. Burgit, Middletown; Warren C. Hillbish, Hummelstown; John W. Kaufman, Hershey, all of Pa.

[73] Assignee: AMP Incorporated, Harrisburg, Pa.

[21] Appl. No.: 786,644

[22] Filed: Nov. 1, 1991

[51] Int. Cl.[5] ..... H01R 13/648

[52] U.S. Cl. ..... 439/108; 439/607

[58] Field of Search ..... 439/108, 607, 609

[56] References Cited

U.S. PATENT DOCUMENTS

| | | | |
|---|---|---|---|
| 4,655,518 | 4/1987 | Johnson et al. | 339/17 |
| 4,867,690 | 9/1989 | Thumma | 439/79 |
| 4,869,677 | 9/1989 | Johnson et al. | 439/80 |
| 4,950,172 | 8/1990 | Annault et al. | 439/108 |
| 4,959,024 | 9/1990 | Czeschka | 439/607 |
| 5,030,140 | 7/1991 | Sugiyama | 439/607 |
| 5,035,631 | 7/1991 | Piorunneck et al. | 439/108 |
| 5,035,632 | 7/1991 | Rudoy et al. | 439/108 |
| 5,037,330 | 8/1991 | Fulponi et al. | 439/607 |

OTHER PUBLICATIONS

U.S. patent application Ser. No. 07/786,696 filed Nov. 1, 1991 (AMP Case: 15209).

U.S. patent application Ser. No. 07/767,344 filed Sep. 27, 1991, which is a continuation of Ser. No. 07/691,167 filed Apr. 24, 1991, now abandoned, which was a continuation of Ser. No. 07/586,360 filed Sep. 21, 1990, now abandoned. (AMP Case 14884).

*Primary Examiner*—Eugene F. Desmond

[57] ABSTRACT

Improved means for securing an externally mounted ground plate to an electrical connector, the ground plate being secured along one of the sides of the connector and having a leading edge thereof exposed at the mating face of the connector and adapted to be received within the housing of a complementary connector upon the connector being mated thereto. The improved means includes a pair of tabs extending from the ground plate proximate the leading edge thereof and engagable with and latchingly securable in cooperating slots on end walls of the connector housing and an inwardly directed rolled portion extending substantially along the entire length of the leading edge of the ground plate, the rolled portion being received within a cooperating recess of the associated housing side wall. The recess is configured to receive rolled edge of the ground plate such that the ground plate lies securely against the side wall and the overall dimensions of the mating face are not substantially increased thereby.

4 Claims, 5 Drawing Sheets

ELECTRICAL CONNECTOR HAVING EXTERNALLY MOUNTED GROUND PLATES

FIELD OF THE INVENTION

This invention relates to an electrical connector assembly and more particularly to connector assemblies having externally mounted ground or shield plates.

BACKGROUND OF THE INVENTION

Most electronic equipment uses a plurality of board-to-board connectors to interconnect circuitry plurality of daughter boards to a mother board or back plane. The circuit boards may be mounted in a vertical or horizontal relationship depending upon the configuration of the mating connector members. The demand for connectors that solve problems such as noise, ground inductance, and cross talk has increased with the density and speed of the electronic circuitry. It is desirable, therefore, that high density electrical connectors include means to provide low inductance and a low resistance ground connection from the connector to the circuit board to which it is attached. It is further desirable that the ground connection be of a type that mates first and breaks last.

U.S. Pat. No. 5,035,631 discloses a grounding shield for a card edge connector. The ground shield is secured to the connector housing by a plurality of fingers that engage apertures along the mating face of the connector.

U.S. Pat. Nos. 4,655,518 and 4,869,677 disclose a two-piece connector assembly that provides grounding contacts within the dielectric walls of the pin header and includes a plurality of ground plates secured by a plurality of tabs to the exterior wall adjacent the mating face of the receptacle member.

U.S. patent application Ser. No. 07/767,344 discloses an electrical connector assembly having a plurality of ground pins in a pin header and ground plates mounted along the exterior walls of the mating receptacle member.

When mounting plates along the exterior walls, particularly along the mating face, it is important that the ground plate lie against the dielectric housing material along the full length to assure proper mating of the connectors without stubbing the contacts in the mating connectors. The problem of separation between the ground plate and housing wall is exacerbated if the dielectric member is at all bowed and tends to separate even slightly from the outer metal wall. It is desirable therefore to provide a means to secure these two layers approximate the mating face such that the overall dimension of the mating face of the connector is not increased. Furthermore, it is desirable that the means for securing be one that minimizes the need for extra parts, one that does not greatly increase the assembly steps and furthermore be one that is cost effective.

SUMMARY OF THE INVENTION

Accordingly, the present invention is directed to an electrical connector having externally mounted ground plates that eliminates the problems and disadvantages of the prior art. For purposes of illustrating the invention, the ground plates are being shown attached to the elongate sides of a connector known as a "pin header".

The connector includes a housing having opposed elongate sides and opposed ends, which together define a mating face, and a plurality of electrical terminal members disposed within the housing and exposed at the mating face for electrical connection to corresponding terminals of a mating connector. The connector further includes at least one ground plate secured along one of the elongate sides and having a leading edge thereof exposed at the connector mating face, the mating face of the connector being adapted to be received within a complementary housing. The improved means for securing the ground plate to the connector includes a pair of tabs extending from the side edges of the ground plate proximate the leading edges thereof and engagable with cooperating slots on the end walls of the housing. The tabs further include locking lances that cooperate with the housing wall slots to lockingly secure the tabs of the ground plate to the housing end walls. The leading edge of the ground plate further includes an inwardly directed rolled portion extending substantially along the entire length thereof. The rolled portion is received within a recessed portion of the elongate side wall of the housing. The recess is configured to receive the rolled edge such that the ground plate lies securely against the elongate side wall and the overall dimensions of the mating face are not substantially increased thereby. When the ground plate is secured to the housing, the pair of locking tabs hold the ground plate securely along the end walls of the housing. The rolled portion strengthens the leading edge of the ground plate and provides a gradually tapered surface at the connector mating face thereby minimizing stubbing of the ground plate when the connector mating face is received in the complimentary connector.

In the preferred embodiment the plate member is also provided with a plurality of inwardly directed stop portions rearwardly of the leading edge, which locate and align the leading edge of the plate with respect to the forward edge of the associated elongate housing wall.

It is an object of the invention to provide a means for securing the ground plate to an external surface of an electrical connector.

It is an additional object to provide a connector having a ground plate mounted externally thereto that minimizes stubbing at the mating face when the mating face is received in a complimentary connector housing.

It is another object of the invention to provide a means for securing a ground plate to an external housing wall in a manner to minimize interruption of the electrical paths.

It is a further object of the invention to provide a means for securing a ground plate to a connector in a manner that does not increase the overall dimensions of the mating face of the connector.

It is yet another object of the invention to provide a means for securing a ground plate to a housing wall in a manner that minimizes separation of the ground plate and the associated wall at the mating face of the connector.

Another object of the invention is to provide a means for securing a ground plate to a connector to ensure that the ground shield mates first and breaks last.

An embodiment of the present invention will now be described by way of example with reference to the accompanying drawings.

DETAILED DESCRIPTION OF THE DRAWING

Figure 1:
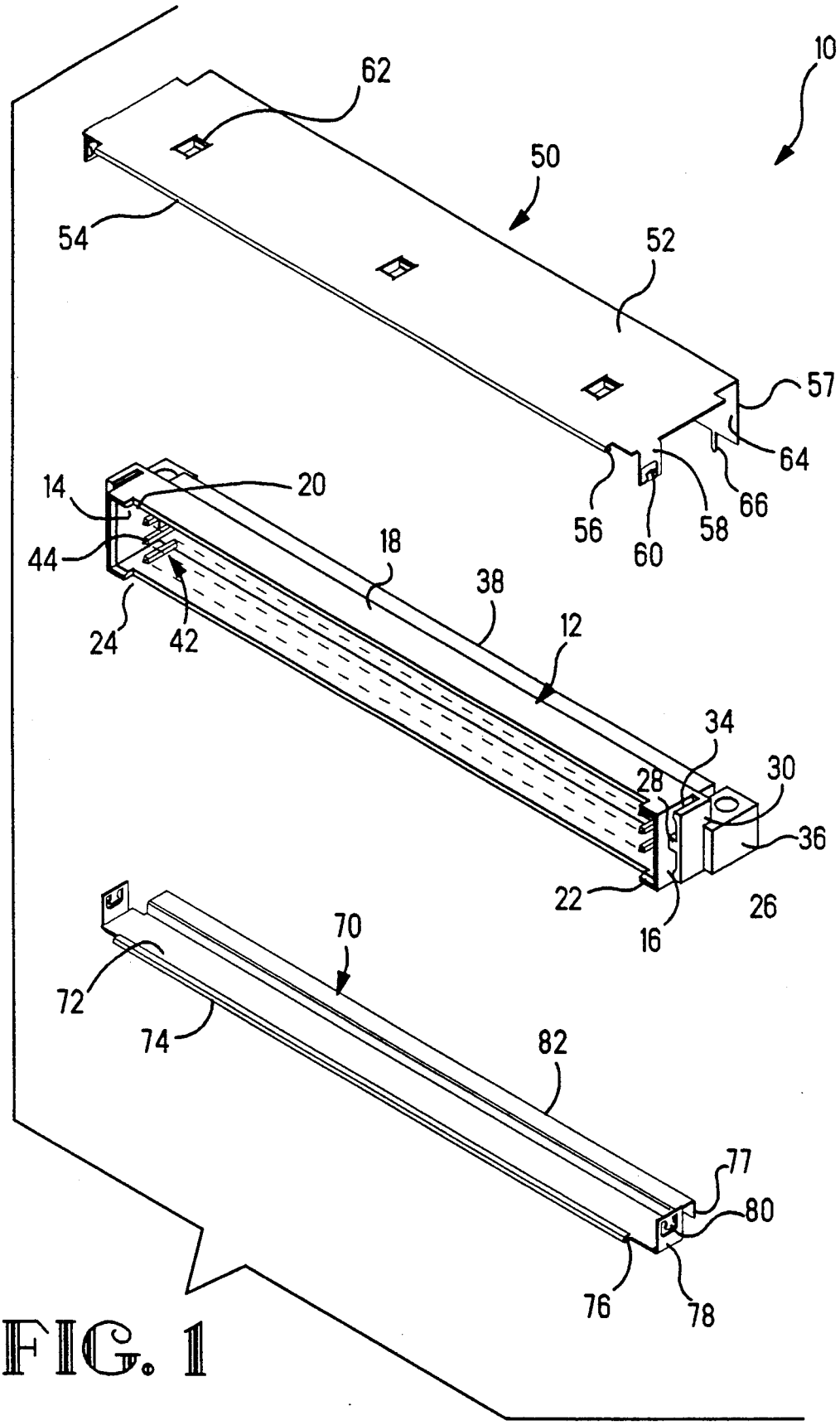
FIG. 1 is an exploded view of a connector having ground plate members secured to upper and lower surfaces in accordance with the invention.
Figure 3:
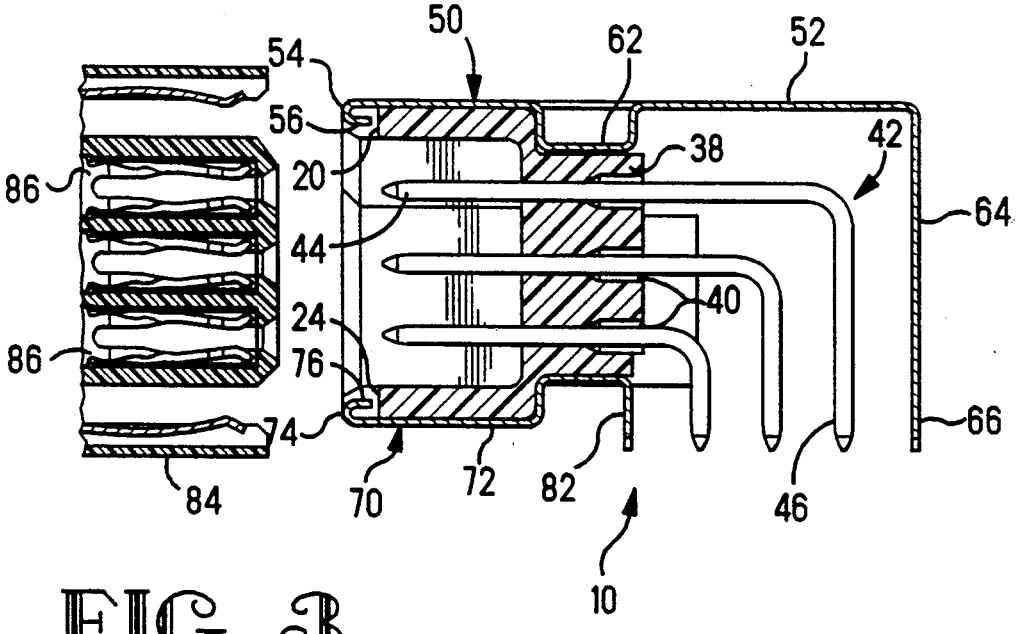
FIG. 3 is a cross sectional view of the assembled connector being received by the mating portion of a complimentary connector.
Figure 4:
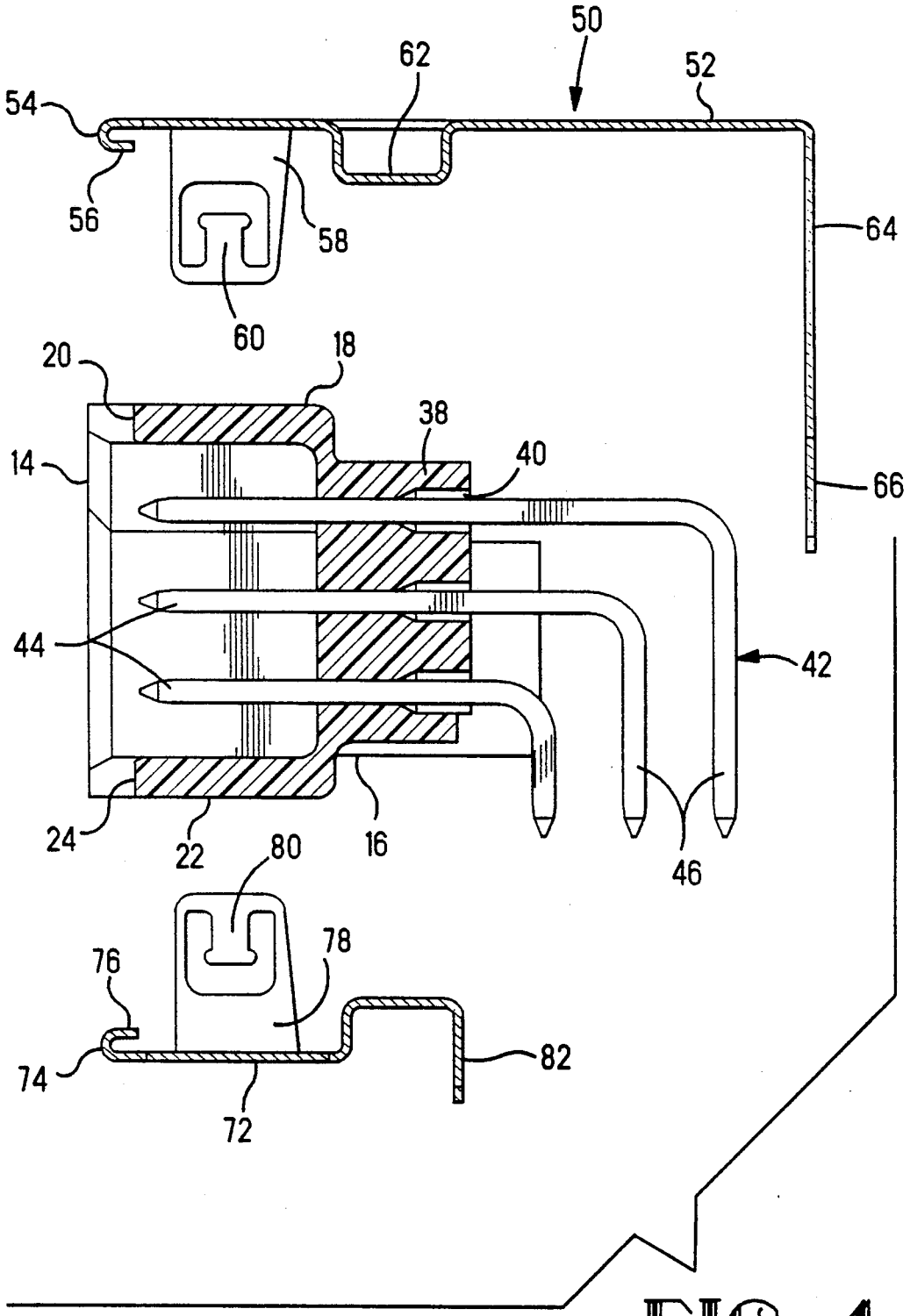
FIG. 4 is an enlarged cross sectional view of the connector of the present invention with the ground plates exploded therefrom.

FIG. 1 shows an exploded view of a pin header connector 10 made in accordance with the invention. Connector 10 includes a housing 12 and upper and lower ground plates 50,70 respectively. Housing 12 includes a mating face 14, mounting face 16 and opposed upper and lower elongate side walls 18,22, opposed end walls 26 and rear wall 38. The opposed elongate side walls 18,22 and opposed end walls 26 define the mating face 14. As best seen in FIG. 1, the upper and lower side walls 18,22 further include recessed portions 20,24 respectively. These portions 20,24 are adapted to cooperate with the respective upper and lower ground plate members 50,70 as more fully described below. A plurality of electrical terminal members 42 are disposed within respective terminal receiving passageways 40 and include first and second connecting portions 44,46 as best seen in FIG. 3. Referring now to FIGS. 1 and 3, first terminal connecting portions 44 are exposed at the mounting face for electrical connection to corresponding terminal members 86 of a mating connector 84.

Figure 5:
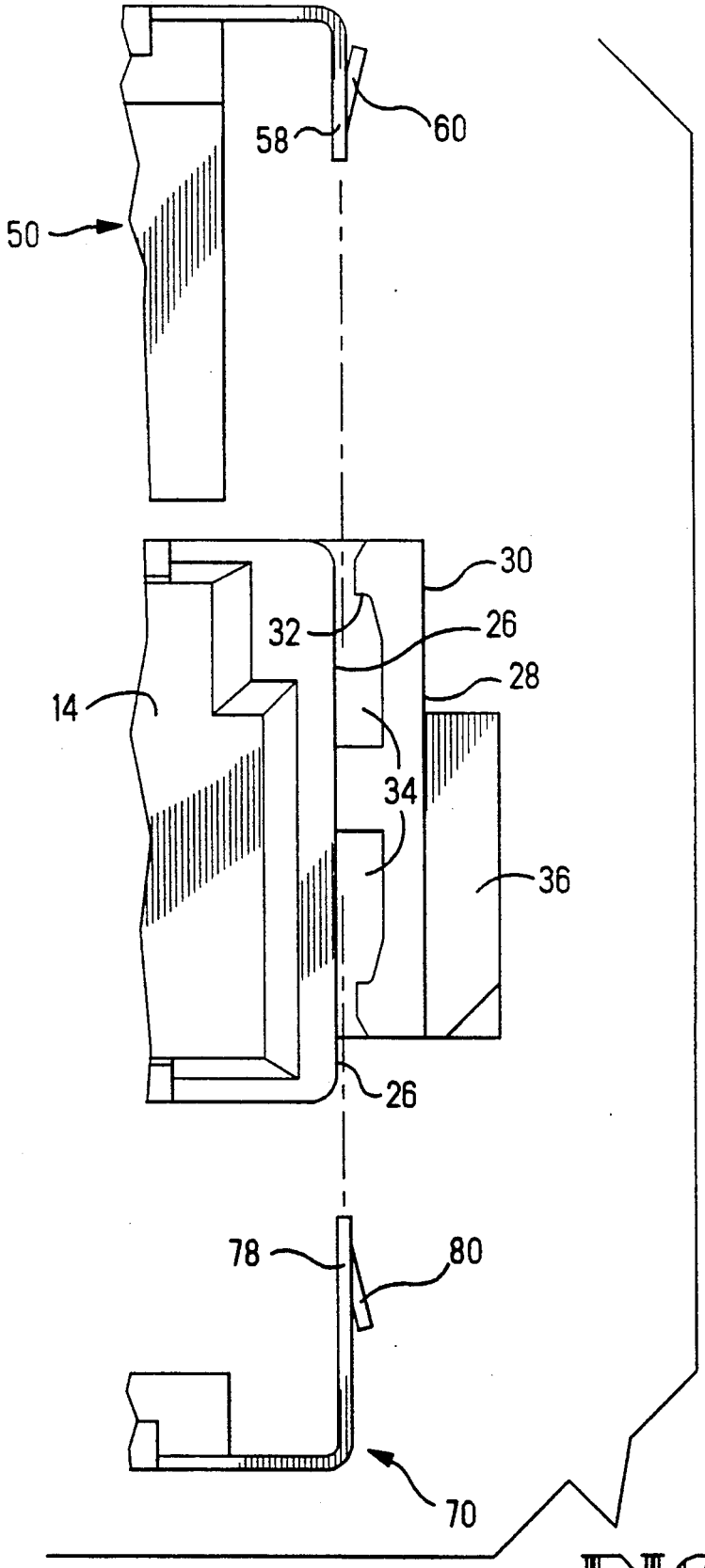
FIGS. 5 and 6 illustrate the interlocking features of the ground plate tabs and housing end walls.
Figure 6:
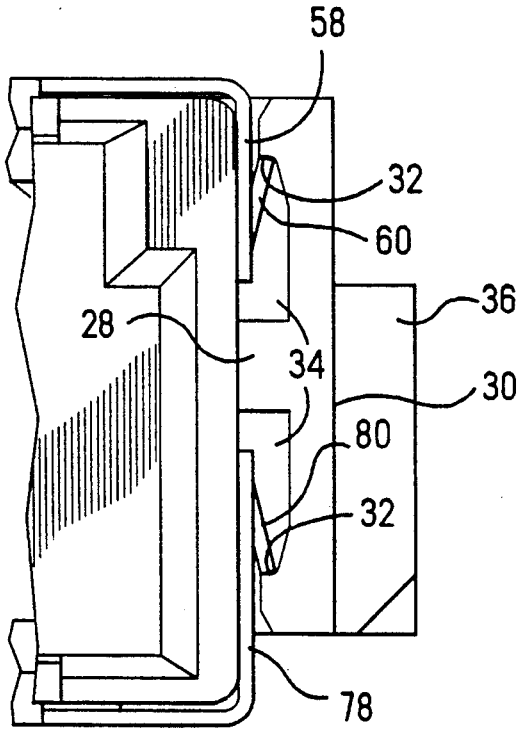

Housing end walls 26 further include outwardly extending first and second flange portions 28,36. First flange portion 28 extends outwardly from the end wall and includes oppositely directed wall portions 30 spaced from wall 26 and defining ground tab receiving cavities therebetween, as best seen in FIGS. 5 and 6. The inner wall portion of 30 further includes a stop ledge 32 at the end thereof for lockingly engaging the ground plate tabs as described more fully below.

Figure 2:
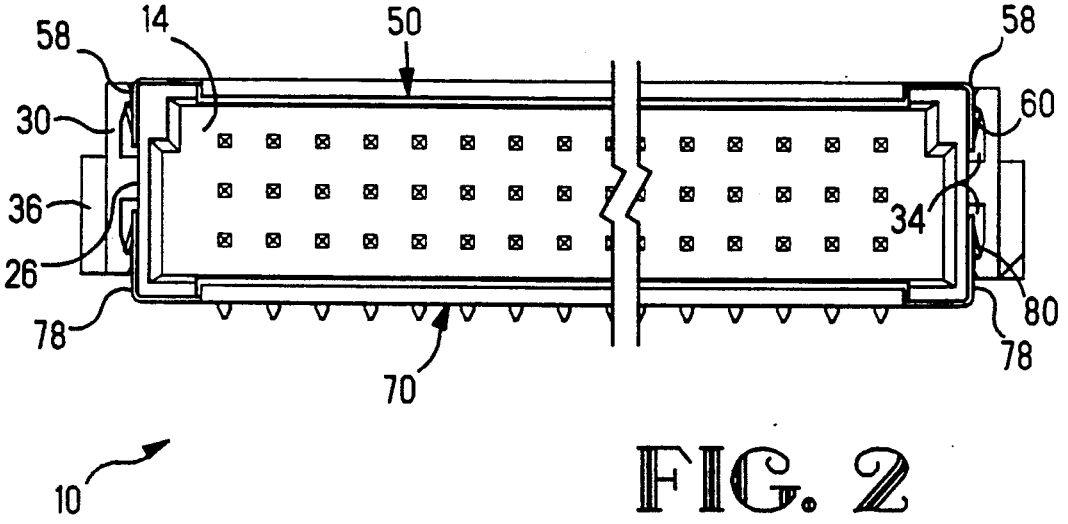
FIG. 2 is a flat plan view of front of the connector of FIG. 1.

Referring now to FIGS. 1, 2 and 3, the upper ground plate 50 includes a top or plate portion 52 having a forward or leading edge 54 that extends to the mating face 14 of connector housing 12 and opposed side edges 57. The leading edge 54 includes a rolled portion 56 which extends substantially along the entire leading edge thereof and is adapted to be received within the cooperating recess 20 of the elongate housing wall 18. Recess 20 is configured to receive rolled edge 56 such that the ground plate 50 lies securely against side wall 18 and the overall dimensions of the mating face 14 are not substantially increased as best seen by FIGS. 2 and 3. Upper ground plate 50 further includes a pair of tabs 58 extending from the side 57 thereof and proximate the leading edge 54. Tabs 58 include outwardly directed locking lances 60 which cooperate with locking surfaces 32 within the tab receiving slots 34 proximate end wall 26 as best seen in FIGS. 5 and 6. Tabs 58 are preferably located as close to the mating face as possible to minimize the problem of separation of the housing side wall and plate member 50.

As best seen in FIGS. 1 and 3 ground plate 50 further includes a rear wall 64 having a plurality of terminal portions 66 for engaging the ground conductors within a circuit board (not shown) when connector 10 is mounted thereto. It is to be understood that the ground plate construction disclosed herein is not limited to right angle pin header connectors only. The connector shown herein is merely representative of various connectors with which the ground plate may be used. U.S. patent application Ser. No. 07/786/696, filed concomitantly herewith, now U.S. Pat. No. 5,137,472, discloses another method for securing a ground plate to a connector housing, in which the leading edges of the wall and ground plate are interlocked at a plurality of locations.

Referring again to FIGS. 1 and 3, lower ground plate 70 includes a plate portion 72 having a leading edge 74 and side edges 77. Lower ground plate 70 further includes a rolled portion 76 extending substantially along the entire length thereof, the rolled portion being adapted to be received within the corresponding recess portion 24 of lower housing wall 22. Recess 24 is configured to receive rolled edge 76 such that the ground plate 70 lies securely against side wall 22 and the overall dimensions of the mating face 14 are not substantially increased as best seen by FIGS. 2 and 3. Lower ground plate 70 also includes tabs 78 extending from the side 77 of plate 72 proximate the leading edge 74 thereof. Tabs 78 include locking lances 80 which are secured in the corresponding lower tab receiving cavity 34 of housing 12 in the same manner as previously described and as best seen in FIGS. 5 and 6. As shown in FIG. 3 the lower ground plate 70 includes terminal members 82 extending downwardly therefrom for being received in a ground plane of the circuit board.

In the preferred embodiment ground plate members 50, 70 further include at least one locating or positioning stop formed in the plate portion 52, 72 rearwardly of the connector mating face 14 to keep the respective leading edges 54, 74 of the ground plate members 50, 70 aligned with the housing walls 18, 22 at the mating face 14. Alternatively, the positioning means may comprise an elongate groove extending along the entire width of the ground plate, or the ground plate may be shaped to conform to the actual shape of the housings.

In assembling the connector of the present invention, the terminal members 42 are inserted into the housing prior to attaching the ground plates 50, 70. The ground plates are then positioned so that the stop means abut the shoulder of the housing 12 and the respective leading edges 54,74 are received in the associated wall recesses 20, 24. The ground plate tabs 58, 78 are inserted into the tab receiving cavities 34 and are locked within the cavities by lances 60, 80 engaging corresponding locking ledges 32.

The ground plates 50,70 are preferably stamped from a formable, electrically conductive metal, such as copper alloys, or the like. Suitable dielectric materials for the connector housing include glass filled polyesters and other similar materials, as known in the art.

The respective rolled portions 56,76 at the forward or leading edge 54,74 of the respective ground plates 50,70 strengthens the leading edge of the assembled connector. Furthermore by providing a recess in the leading wall edges of the housing member and filling that recess with the respective rolled portions 56,76 there is less chance that stubbing will occur when connector 10 is mated to another connector, since there is a continuous surface along the bulk of the mating face of the connector. Stubbing is thereby minimized and insertion force is reduced by the gradual tapered rolled surface of the plate members 50,70.

It is thought that the electrical connector assembly of the present invention and many of its attendant advantages will be understood from the foregoing description. It is apparent that various changes may be made in form, construction and arrangement of the parts thereof without departing from the spirit or scope of the invention or sacrificing all of its material advantages.

We claim:

1. An improved means for securing an externally mounted ground plate to an electrical connector, the connector including a housing having opposed elongate sides and opposed ends defining a mating face, a plurality of electrical terminal members disposed within electrical connection to corresponding terminal members of a mating connector, said mating face being adapted to be received within a complementary housing, said connector further including a pair of cooperating ground plates, where each ground plate is secured along one of the elongate sides and having a leading edge thereof exposed at the mating face and adapted to be received within said complementary housing, the improved means comprising:

a pair of tabs extending essentially perpendicular from each said ground plate proximate the leading edge thereof and engagable with cooperating slots on said end walls of said housing, said pair of tabs including outwardly extending locking lances which cooperate with said end wall slots to lockingly secure said ground plate to said housing end walls; and said leading edge of each said ground plate includes an inwardly directed rolled portion extending substantially along the entire length thereof, said roller portion being received within a cooperating recess of said elongate housing side wall, said recess being configured to receive said rolled edge such that said ground plate lies securely against the side wall and the overall dimensions of the mating face are not substantially increased thereby, whereby when said ground plate is secured to said housing, said pair of locking tabs hold said plate securely to the end walls of the connector housing and said rolled portion strengthens the leading edge of said ground plate, to provide a gradually tapered surface at the connector mating face and minimize stubbing of said ground plate when the mating face is received in the complementary connector.

2. The improved means of claim 1 wherein each ground plate further includes means for positioning and aligning said ground plate on said housing side wall.

3. An improved means for securing externally mounted ground plates to an electrical connector, the connector including a housing having opposed elongate sides and opposed ends defining a mating face, a plurality of electrical terminal members disposed within said housing and exposed at said mating face for electrical connection to corresponding terminal members of a mating connector, said mating face being adapted to be received within a complementary housing, said connector further including a ground plate secured along both of said elongate sides and having respective leading edges thereof exposed at the mating face and adapted to be received within said complementary housing, the improved means comprising:

a pair of tabs extending essentially perpendicular from each of said ground plates proximate the leading edge thereof and engagable with respective cooperating slots on said end walls of said housing, said pair of tabs including outwardly extending locking lances which cooperate with said end wall slots to lockingly secure said ground plates to said housing end walls; and said leading edge of each ground plate includes an inwardly directed rolled portion extending substantially along the entire length thereof, said rolled portion being received within a cooperating recess of the corresponding elongate housing side wall, said recess being configured to receive said rolled edge such that the respective ground plates lie securely against the respective side walls and the overall dimensions of the mating face are not substantially increased thereby, whereby when said ground plates are secured to respective ones of said elongate walls of said housing, said pair of locking tabs hold said plate securely to said end walls of the connector housing and said rolled portions strengthen the leading edges of the ground plate, provide a gradually tapered surface at the connector mating face and minimizes stubbing of the ground plates when the mating face is received in the complementary connector.

4. The improved means of claim 3 wherein said ground plates further include means for positioning and aligning said ground plates on respective housing side walls.

* * * * *

UNITED STATES PATENT AND TRADEMARK OFFICE

CERTIFICATE OF CORRECTION

PATENT NO. : 5,174,771
DATED : December 29, 1992
INVENTOR(S) : Richard A. Burgit et al.

It is certified that error appears in the above-indentified patent and that said Letters Patent is hereby corrected as shown below:

In The Claims:

Claim 2, Column 6, Line 4 - Enter the word --said-- before "ground".

Signed and Sealed this

Twenty-second Day of March, 1994

Bruce Lehman

*Attest:*

BRUCE LEHMAN

*Attesting Officer*

*Commissioner of Patents and Trademarks*